US010609949B2

(12) United States Patent
Hodin et al.

(10) Patent No.: US 10,609,949 B2
(45) Date of Patent: Apr. 7, 2020

(54) TOBACCO OR NON-TOBACCO PRODUCT COMPRISING MAGNESIUM CARBONATE

(75) Inventors: Fredrik Hodin, Ronninge (SE); Jorgen Lundin, Upplands-Vasby (SE)

(73) Assignee: Swedish Match North Europe AB, Stockholm (SE)

( * ) Notice: Subject to any disclaimer, the term of this patent is extended or adjusted under 35 U.S.C. 154(b) by 1053 days.

(21) Appl. No.: 12/808,315

(22) PCT Filed: Oct. 31, 2008

(86) PCT No.: PCT/SE2008/051242

§ 371 (c)(1),
(2), (4) Date: Jun. 15, 2010

(87) PCT Pub. No.: WO2009/082331

PCT Pub. Date: Jul. 2, 2009

(65) Prior Publication Data

US 2010/0294292 A1 Nov. 25, 2010

Related U.S. Application Data

(60) Provisional application No. 61/015,680, filed on Dec. 21, 2007.

(30) Foreign Application Priority Data

Dec. 21, 2007 (SE) ..... 0702857

(51) Int. Cl.
*A24B 13/00* (2006.01)
*A24B 15/28* (2006.01)

(52) U.S. Cl.
CPC ..... *A24B 13/00* (2013.01); *A24B 15/28* (2013.01); *A24B 15/287* (2013.01)

(58) Field of Classification Search
None
See application file for complete search history.

(56) References Cited

U.S. PATENT DOCUMENTS 4,033,359 A 7/1977 Borthwick et al.
4,606,357 A 8/1986 Dusek et al.
(Continued)

FOREIGN PATENT DOCUMENTS

CA 2653342 A1 12/2007
CA 2707001 A1 6/2009
(Continued)

OTHER PUBLICATIONS

Somani, Padmini, "Tobacco Use in the Indian Subcontinent," 13th World Conference on Tobacco or Health, Jun. 2006. Accessed: http://2006.confex.com/uicc/wctoh/techprogram/P4512.HTM on Apr. 22, 2012.*

(Continued)

*Primary Examiner* — Michael J Felton
(74) *Attorney, Agent, or Firm* — Knobbe Martens Olson & Bear LLP

(57) ABSTRACT

There is provided a tobacco product or a non-tobacco snuff product, including a magnesium carbonate, for conferring pH stability to the product and preventing growth of bacteria and fungi therein. The magnesium carbonate may contain hydroxide, oxide, and crystal water. The amount of magnesium carbonate ranges from 0.01 and 30% by weight of the dry bulk material. The product may be combined with additional pH regulators. The magnesium carbonate significantly increase the pH-stability in snus and non-tobacco snuff at the normal pH-range used in these products. The final product, which may be oral snuff or snus, or any tobacco-free snuff product, may be in particulate form, or shaped in a variety of forms. The product may be an oral product. The product may be packaged in a box, can or (Continued)

canister. Use of a magnesium carbonate for producing the products is also described.

31 Claims, 9 Drawing Sheets

(56) References Cited

U.S. PATENT DOCUMENTS

| | | | | |
|---|---|---|---|---|
| 4,848,373 | A | 7/1989 | Lenkey | |
| 5,662,920 | A | 9/1997 | Santus | |
| 5,869,084 | A * | 2/1999 | Paradissis et al. | 424/439 |
| 2004/0037879 | A1* | 2/2004 | Adusumilli et al. | 424/468 |
| 2005/0061339 | A1* | 3/2005 | Hansson et al. | 131/352 |
| 2007/0186941 | A1* | 8/2007 | Holton et al. | 131/352 |
| 2007/0261707 | A1 | 11/2007 | Winterson et al. | |
| 2009/0065013 | A1 | 3/2009 | Essen et al. | |

FOREIGN PATENT DOCUMENTS

| | | | |
|---|---|---|---|
| EP | 0 215 682 | A2 | 3/1987 |
| GB | 772 647 | A | 4/1957 |
| GB | 1299641 | A | 12/1972 |
| GB | 1 316 987 | A | 5/1973 |
| GB | 2 003 721 | A | 3/1979 |
| JP | 52031440 | B | 8/1977 |
| SE | 06 009 58-3 | L | 10/2007 |
| WO | 20041056219 | A1 | 7/2004 |
| WO | 2006120570 | A2 | 11/2006 |
| WO | 20081133563 | A1 | 11/2008 |

OTHER PUBLICATIONS

Bombay High Court, "Dhariwal Industries Ltd. and Anr. vs Union of India (Uoi) and Ors. on Sep. 18, 2002", Sep. 2002. Accessed via: http://indiankanoon.org/doc/123543/ on Dec. 12, 2012.*

Burney, Shahid Raza, "Maharashtra imposes ban on gutka", Jul. 19, 2002, Arab News. Accessed via http://www.arabnews.com/node/222644 on Dec. 12, 2012.*

Ciolino, Laura A., et al., "The Relative Buffering Capacities of Saliva and Moist Snuff: Implications for Nicotine Absorption", Journal of Analytical Toxicology, vol. 25 Jan./Feb. 2001.*

National Drug Strategy Network, "New Questions About Snuff Tobacco Industry", Nov. 1994, www.ndsn.org/nov1994/snuff.html.*

Canadian Office Action, dated Sep. 29, 2011, in Application No. 2,708,883.

International Search Report, dated Feb. 23, 2009, from corresponding PCT application.

Translation of Japanese Office Action, dated Aug. 21, 2012, from corresponding JP application.

Extended European Search Report in EP App. No. 08864384.6 (National Phase of PCT/SE2008051242), dated Sep. 18, 2017.

* cited by examiner

TOBACCO OR NON-TOBACCO PRODUCT COMPRISING MAGNESIUM CARBONATE

FIELD OF INVENTION

The current invention pertains to a tobacco product or a non-tobacco snuff product comprising a magnesium carbonate.

BACKGROUND

The storage stability of dry or moist tobacco products or non-tobacco snuff products demands that the product is maintained at a sufficiently high and fairly constant pH during the entire storage period. This presents a problem in all products of this type but especially as regards moist products since their pH decreases more rapidly than that of the corresponding dry products. Moreover, moist products can be susceptible to microbial growth.

In most non-smoking (oral) tobacco products a pH-regulating agent is needed to increase the amount of unprotonized nicotine which is absorbable by the mucous membrane. At increased pH bacterial growth is also prevented. Soda (sodium carbonate) is the most common such agent. Soda is cheap and easy to handle. However, soda and other pH-regulating agents used have a plain drawback—they do not endow moist products desired storage capability.

A few days after production, the pH of the moist product starts to drop, albeit slowly. Storage at room temperature may spoil moist snuff in 1-2 months. This problem is normally counteracted by three actions, all of which may be combined. Firstly, the problem may be solved by addition of as much soda as possible. This in reality involves adding soda until the pH reaches a value just below 9. Too basic pH-values would result in damage to the user's mucous membrane in the mouth. Secondly, a solution to the problem may entail keeping the product refrigerated until sold, to slow down the processes leading to a decrease in pH. Thirdly, the storage problem may be overcome by frequent production, thus ensuring that a fresh, newly produced product is at all times available on the market. These actions in most cases yield good quality products, although the actions have their intrinsic limitations. For export purposes, for example, the above-mentioned actions are not sufficient or not possible to carry into effect altogether. Although the state of the art actions described may be used to provide a high quality product, there is room for improvement.

DESCRIPTION OF THE INVENTION

The above-mentioned problems of suboptimal storage capability and growth of bacteria and fungi are counteracted by providing an improved moist tobacco product or a non-tobacco snuff product in accordance with the current invention.

According to a first aspect of the invention, there is provided a tobacco product or a non-tobacco snuff product, comprising a magnesium carbonate.

According to another aspect of the invention, there is provided a tobacco or non-tobacco snuff product, comprising a magnesium carbonate.

The magnesium carbonate, which may be in the product in an excess amount, counteracts the rising acidity of the product, due to neutralisation of basic compound(s). The resulting pH stability is of primary concern for a tobacco-containing oral product, such as tobacco-containing snuff, since nicotine is better absorbed by the mucous membrane in a basic environment. In oral tobacco and non-tobacco products, magnesium carbonate contributes to raising and keeping up the pH, which reduces the risk for caries.

In one embodiment of the invention, the tobacco product or non-tobacco snuff product is an oral product.

Magnesium carbonates have an advantage in the context of the invention, in that magnesium carbonates are classified as food-grade supplements by many authorities, and hence may be readily used in a product of the invention.

Compounds to be utilized as better pH-regulating agents than soda must have suitable water solubility, to prevent immediate release of the entire amount of the compound. Suitable water solubility makes way for the formation of a depot of the compound. Magnesium carbonates are much less soluble than sodium carbonates and much more soluble than calcium carbonates. Their intermediate solubility makes it possible to make a carbonate depot, which slowly releases carbonate ions to maintain a stable pH. Exemplary compounds belong to the group comprising magnesium together with carbonate(s) and/or basic carbonate(s).

According to an embodiment of the current invention, there is provided a magnesium carbonate containing hydroxide(s), oxide(s) and/or crystal water. The magnesium carbonates may be divided in two classes: magnesium carbonate, $MgCO_3.XH_2O$ and magnesium hydroxy carbonate, $Mg(CO_3)_y(OH).XH_2O$. In both of these classes there are also compounds without crystal water (X=0) and compounds with the same formula but different crystal structure. Y and Z are known to the person skilled in the art to be variable. Neither X nor Y need to be an integer. Y may moreover be 0 for an additive to the composition for in situ generation of magnesium carbonate. Some of the compounds are naturally occurring minerals, whereas others have to be manufactured. The group consists of more than 35 different compounds, all with their own individual CAS-number. All of these compounds might be useful in the products of the current invention.

It has, however, been found that the form in which the magnesium carbonate exists in the product is of lesser importance. The content of hydroxide or oxide in the magnesium carbonate appears not to influence the storage capabilities of the product considerably. Likewise, the amount of crystal water contained in the magnesium carbonate seems to be negligible as a factor influencing the maximum storage time of the product.

A storage time of at least half a year at room temperature has been proved for tobacco products and non-tobacco snuff products comprising a magnesium carbonate according to the invention, whereas products not containing a magnesium carbonate are known to have a storage time of approximately one to two months at room temperature. Refrigerated products of the present invention may have a stable pH for up to one year.

It is readily understood that the magnesium carbonate needs not to be added to the product as such, but may instead be formed by a chemical reaction between various component parts contained in the product itself, component parts that may be added separately.

According to one embodiment, a magnesium carbonate is present in the product in an amount of from 0.01 to 30% by weight of the dry bulk material. According to another embodiment of the invention, a magnesium carbonate is present in an amount of from 0.1 to 20% by weight of the dry bulk material. According to yet another embodiment of the current invention, a magnesium carbonate is present in an amount of from 0.5 to 5% by weight of the dry bulk material.

Commonly, it is desired to retain the moisture content in the product. Many consumers tend to express a preference towards moist products over dry products, as regards said products for oral use. A magnesium carbonate may however advantageously be kept at a rather high concentration within the concentration interval, since it is much less corrosive to the mucous membrane than soda. It may thus be used as filler.

According to one embodiment, the product may also contain additional pH-regulator(s) selected from the group consisting of sodium carbonate, sodium bicarbonate, sodium hydroxide, potassium carbonate, potassium bicarbonate, potassium hydroxide, phosphates. These may advantageously be used to swiftly reach the desired pH during production, whereby the magnesium carbonate chosen is thereafter utilized to stabilise the pH in the basic region. However magnesium carbonate may in itself lend the product a sufficiently basic pH, without the need for additional pH regulator(s). Above-mentioned additional pH-regulator (s) all have good characteristics and may be used in the product, depending on national or regional food legislation. For example, the use of phosphates as a food supplement is limited in many countries.

According to yet an embodiment of the invention, the product reaches a pH in the range from 7 to 9, for example from 8 to 8.5. At a basic pH, nicotine of a tobacco product is more readily absorbed by the mucous membrane. The fraction of absorbable, unprotonized nicotine increases with pH, as shown in FIG. 1. Stability of the pH in the basic region is directly correlated to and a prerequisite for storage ability. Below 7, an insubstantial amount of nicotine is released from the tobacco-containing product, whereas a too basic pH may cause damage to the mucous membrane. If magnesium carbonate is used as the sole means for raising the pH of the product, a period of time of several days to weeks would likely be needed for the pH to gradually reach its highest value.

Tobacco product is used herein as a denomination comprising oral snuff including Swedish heat-treated oral snuff (a.k.a. snus), chewing tobacco, and snuff-like chewing tobacco products. The expression also encompasses snuff products to be administered nasally.

Non-tobacco snuff product is used herein as describing a snuff product that as component part(s) comprise(s) pharmacologically active or inactive components, but not tobacco. The non-tobacco product is a non-chewing gum product; i.e neither comprises rubber nor natural latex such as chicle. The non-tobacco snuff product is an oral product. An example of a non-tobacco snuff product is a product made from plant fibers such as maize, oat etc. to be used in the same way as an oral tobacco snuff product.

"Oral" and "oral use" is in all contexts used herein as a description for use in the oral cavity, i.e. chewing purposes, or placement buccally. It does however exclude, as used herein, products to be intentionally swallowed.

The tobacco or non-tobacco product is in one embodiment in a loose, particulate form. According to another embodiment, the tobacco product is formulated as oral snuff or snus, using state of the art techniques. This oral snuff or snus may be in a loose, particulate form. In the USA oral snuff is understood as an oral tobacco product most frequently produced in a fermentation process. "Snus", which is the Swedish term for oral snuff, is used herein as a description for an oral tobacco product produced in a heat-treatment process. In accordance with one embodiment of the current invention, the tobacco product or a non-tobacco product is provided in the form of a pouch, pellet, pod, cake, strip or stick.

The final product or an intermediate product is for transport, storage and commercial purposes according to one aspect of the invention packaged in a box, can or canister.

According to an aspect of the current invention, use is made of a magnesium carbonate for producing a tobacco product or a non-tobacco snuff product. The product produced may be an oral product. Commonly, magnesium carbonate would be added at the end of the manufacturing process. The sequence of additions may be varied.

Dry bulk material is used herein as a term for the component parts of the products, prior to application of the moist-contributing parts of the product, such as water. The moist-contributing parts may lend the product a desirable moist content within a wide range.

It is understood that the current invention has its most apparent use for moist products; it may however naturally also lend the preservative and pH stabilizing characteristics provided to dry tobacco or non-tobacco products, such as a dry tobacco product or dry non-tobacco snuff.

The present invention will now be described with reference to the accompanying figures. The embodiments and examples presented herein shall merely be seen as illustrations of the spirit and scope of the current invention, and in no way whatsoever as limitations.

SHORT DESCRIPTION OF THE FIGURES

FIG. 1 graphically depicts the part of unprotonized nicotine at various pH values in a diluted water solution.

FIG. 2 graphically depicts the change in pH of the loose snus reference sample 851 R and the sample containing magnesium hydroxy carbonate 851M, respectively, during storage at room temperature and refrigerated storage, respectively.

FIG. 3 graphically depicts the change in pH of the portion snus samples 881 R (reference) and 881 M (containing magnesium hydroxy carbonate), respectively, during storage at room temperature and refrigerated storage, respectively.

FIG. 4 graphically depicts the change in pH of the portion snus samples 881 RL (reference) and 881 ML, the latter containing magnesium hydroxy carbonate, during storage at room temperature and refrigerated storage, respectively.

FIG. 5 graphically depicts the change in pH of loose snus admixed with two different kinds of magnesium carbonates, respectively, during storage at room temperature.

Figure 8:
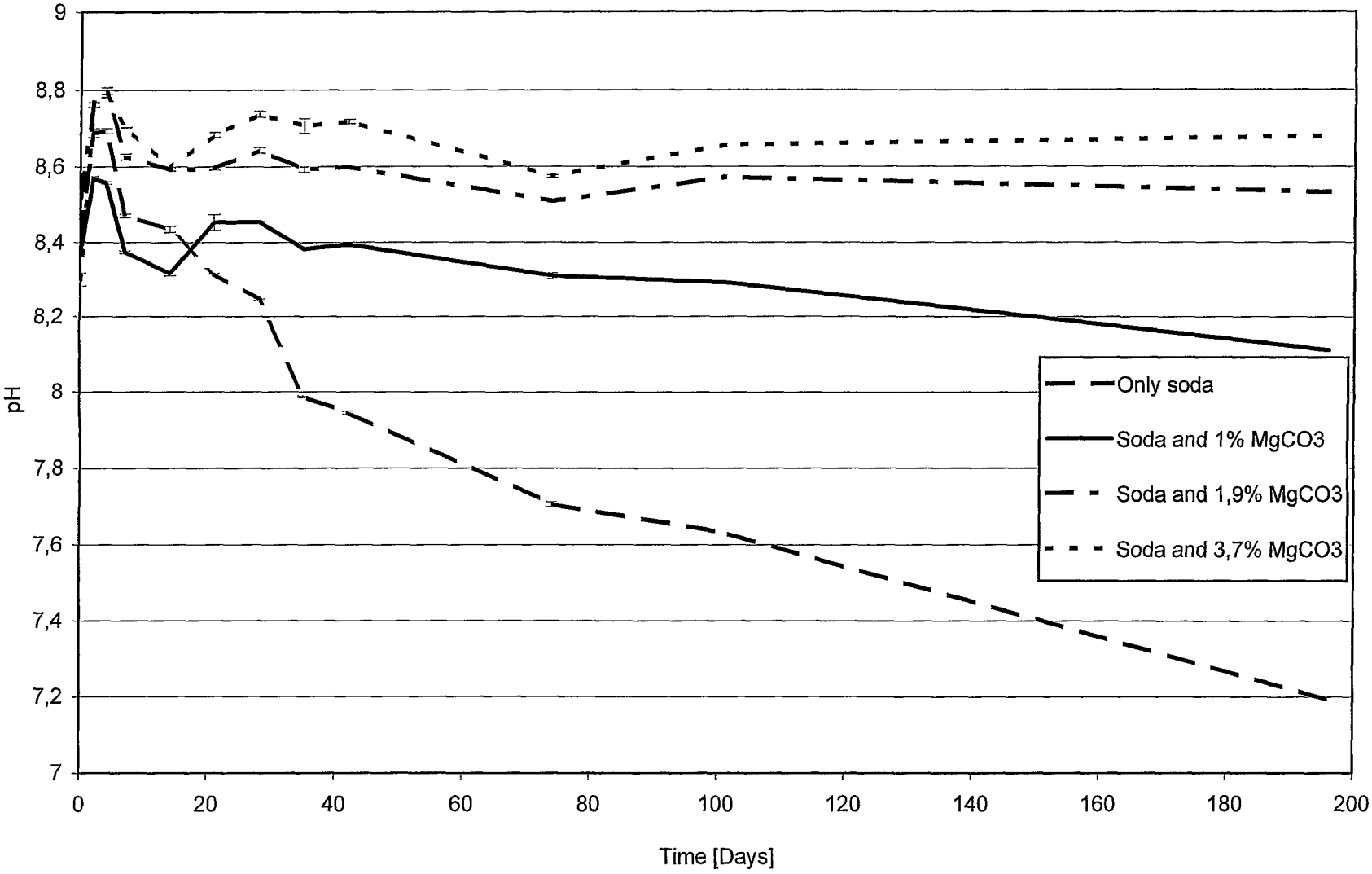

FIG. 8 graphically depicts the change in pH of loose snus admixed with soda and different amounts of magnesium carbonates, respectively, compared with a sample only containing sodium carbonate as additive. Samples stored at room temperature.

Figure 9:
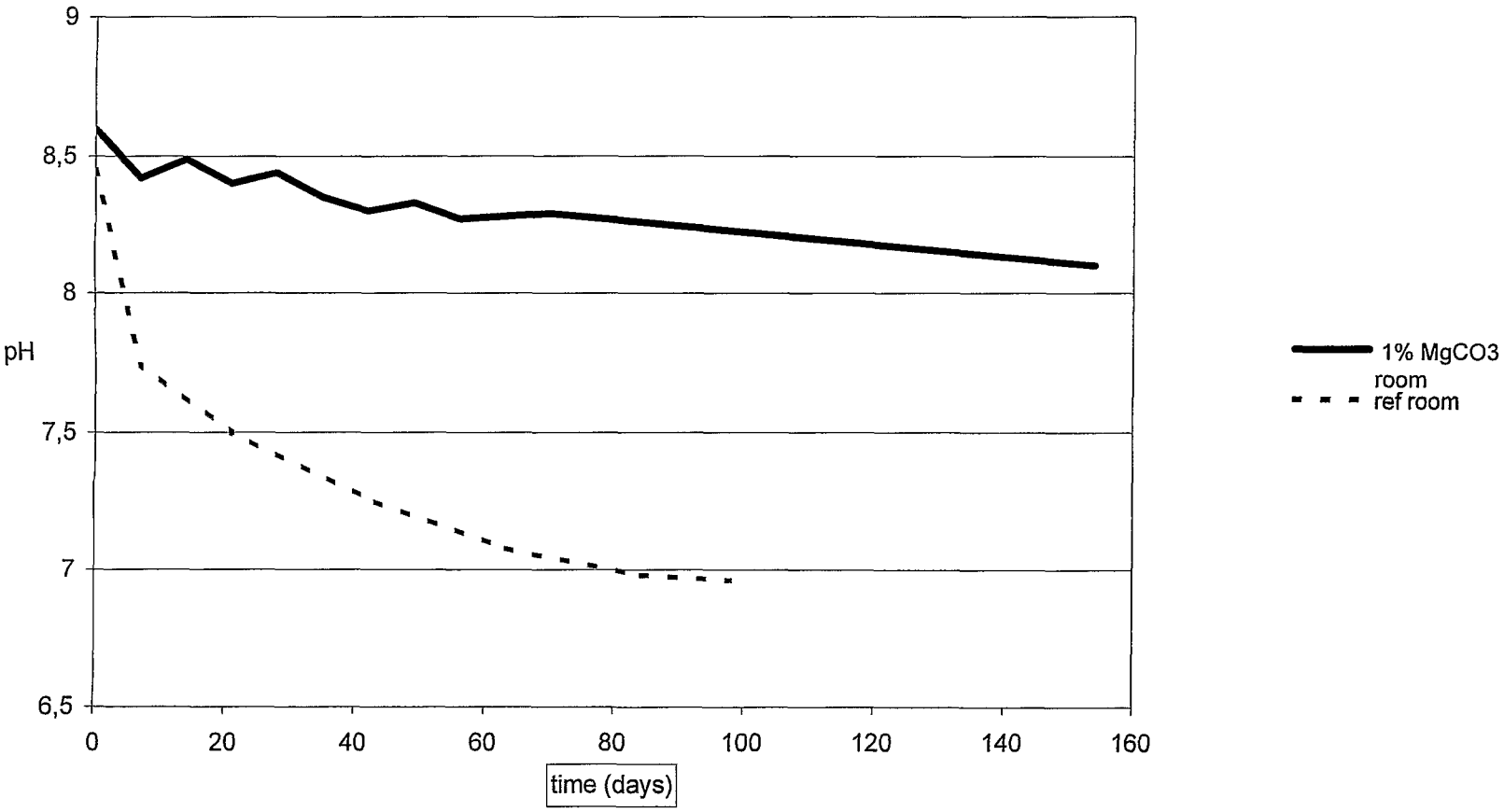

FIG. 9 graphically depicts the change in pH of non-tobacco oral snuff comprising 1% $MgCO_3$ stored at room temperature, compared with a reference sample of non-tobacco oral snuff devoid of MgCO3, stored at room temperature.

EXPERIMENTAL SECTION

The method of production of tobacco and non-tobacco oral products used is in accordance with the Swedish Match quality standard for snus "GothiaTek®", which has been previously described in e.g. patent applications SE 06 009 58-3 and PCT/SE2007/050792. This and other means for manufacture of tobacco products and non-tobacco snuff products are well within the scope of the competence of the person skilled in the art, who readily appreciates that the constituent parts of the products may be exchanged for similar constituents. Below, specific illustrative examples are given for showing the storage capability of snus in accordance with the invention, compared with corresponding products comprising sodium carbonate as the sole pH regulating agent.

Measurement of pH in Snus

For all pH measurements described herein, 5 grams of the product is weighed in using a 100 ml Erlenmeyer flask. 100 ml of distilled water is added, whereupon the mixture is stirred for 10 minutes with a magnetic stirrer at 300 r/min. The pH-meter is calibrated (according to the manufacturer's instructions) using buffers with the respective pH-values of 4.0, 7.0, and 10.0. For correctness of readings, the sample solutions shall be analyzed within one hour.

EXAMPLES

Figure 1:
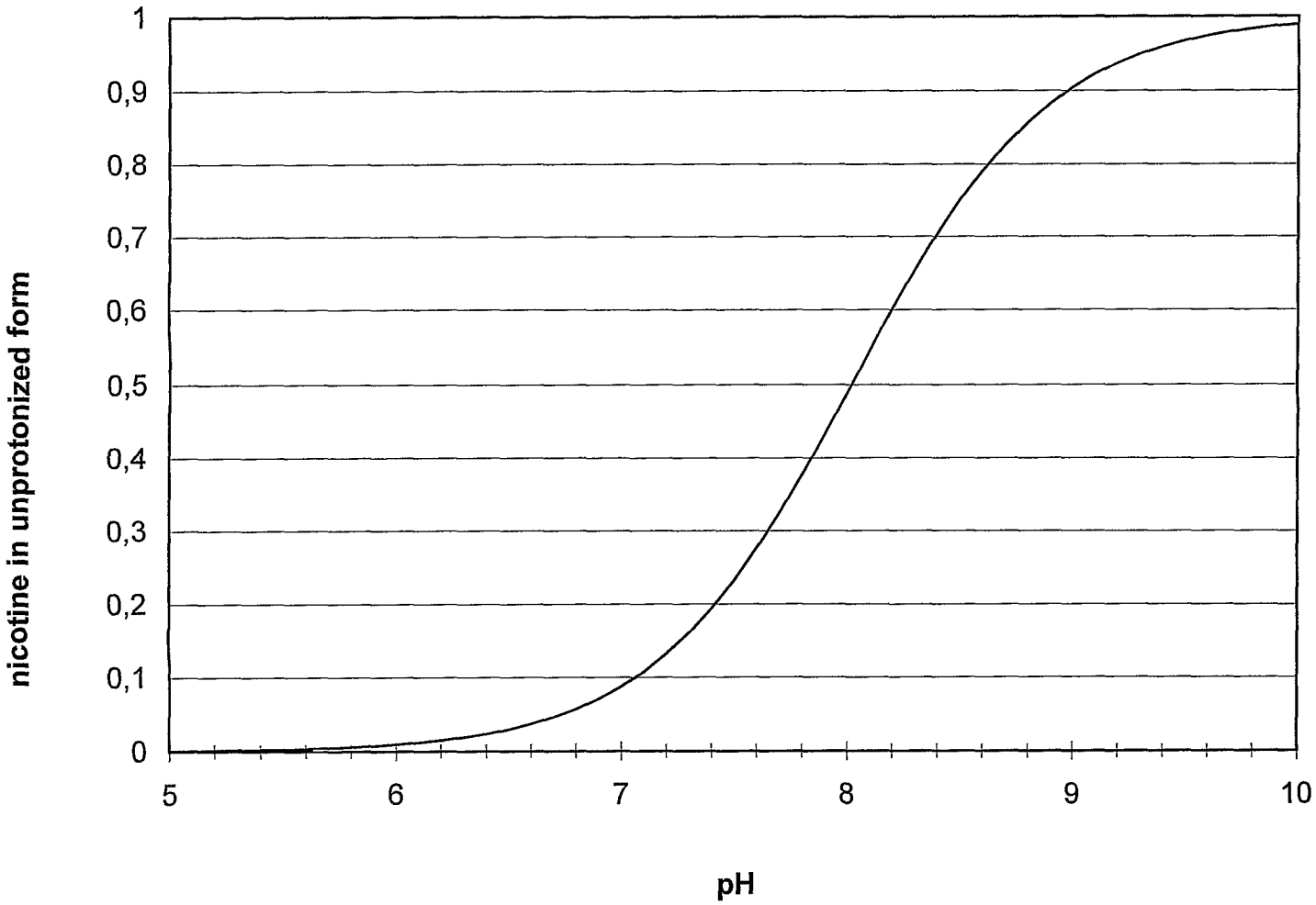
Figure 2:
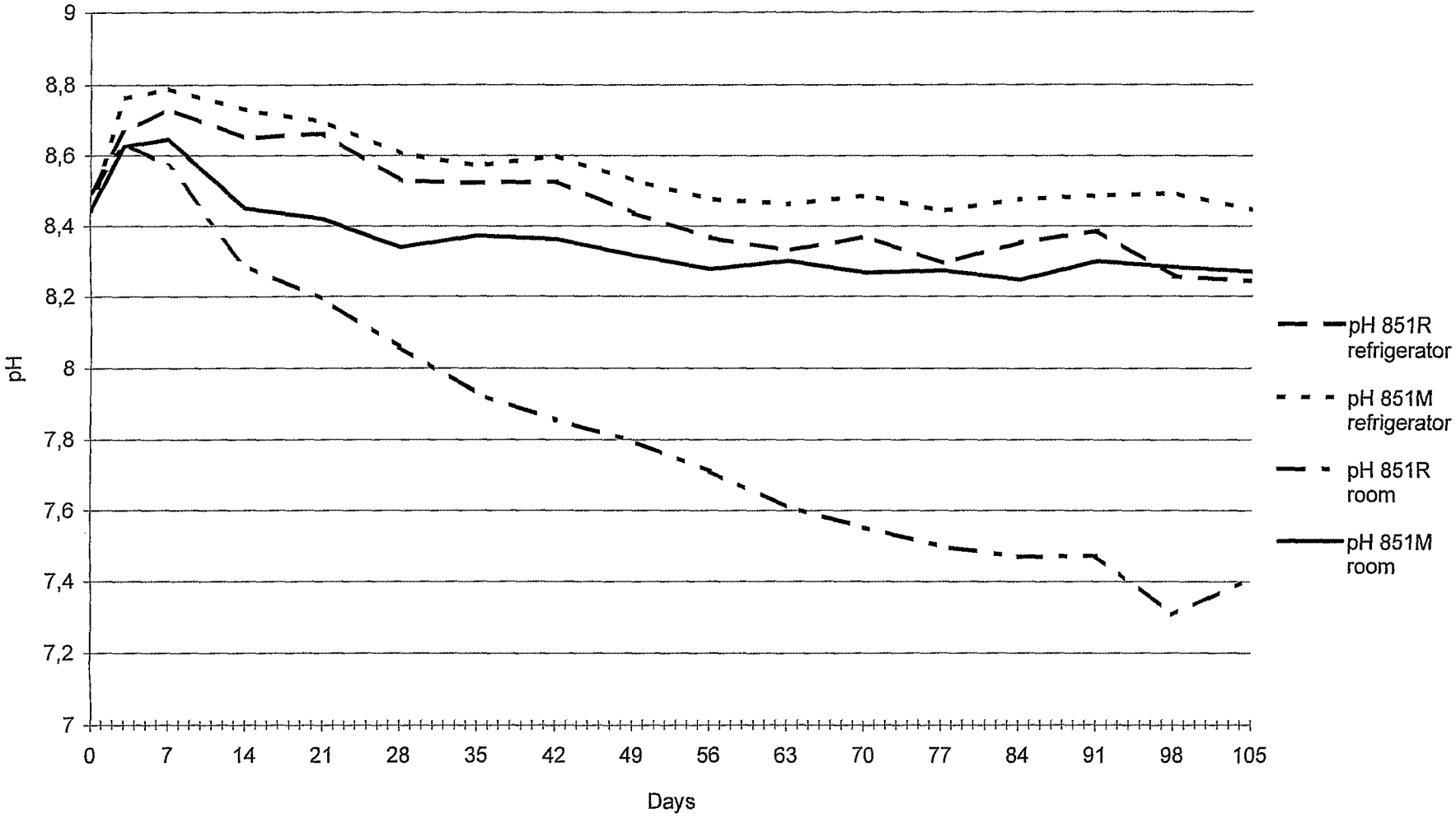

Example 1 (See FIG. 2)

Snus was manufactured in accordance with the GothiaTek® standard with NaCl and soda according to recipe 851. Sample 851 R (reference) was not further treated. To sample 851 M, 1% (of the end product) of magnesium carbonate (CAS-number 546-93-0, UnivarFiskefood AB, Box 4072, Kalendegatan 26, SE-203 11 Malmö, Sweden, product no. MA2725) was added. Both samples were packed as loose snuff (snus) in standard cardboard cans. Each sample was stored at room temperature and in refrigerator (4-8° C.), respectively. pH was measured on day 1 and 3 and subsequently every week until 105 days had passed. FIG. 2 shows the pH-time graph. The experiment shows that addition of $MgCO_3$ and storage at room temperature gives about the same stabilizing effect, as cold storage without $MgCO_3$.

Figure 3:
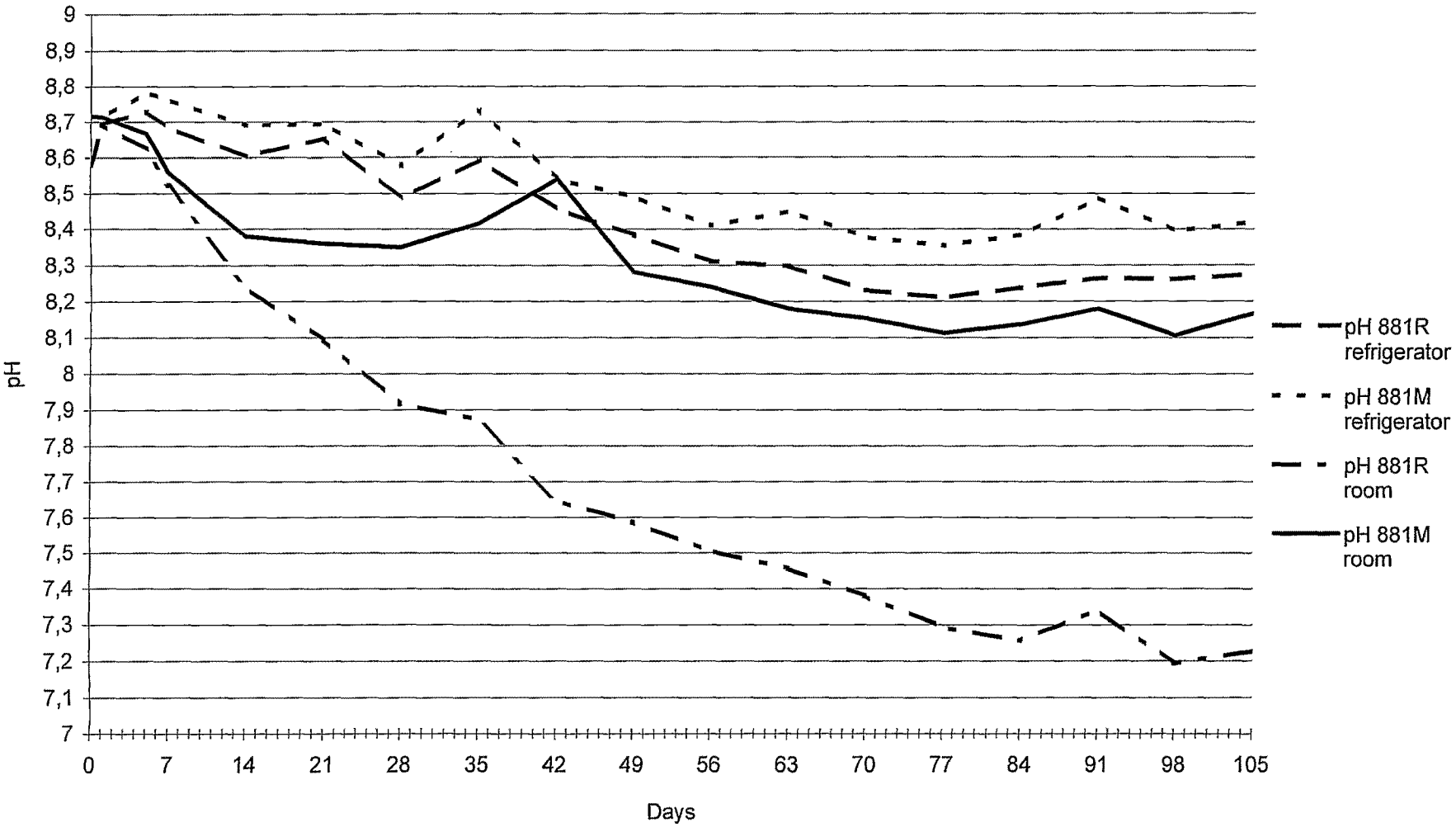

Example 2 (See FIG. 3)

Snus was manufactured in accordance with the GothiaTek® standard with NaCl and soda according to recipe 881. Sample 881 R (reference) was not further treated. To sample 881 M, 1% (of the end product) of magnesium carbonate (CAS-number 546-93-0, UnivarFiskefood AB, Box 4072, Kalendegatan 26, SE-203 11 Malmö, Sweden, product no. MA2725) was added. Both samples were filled into pouches to portion snuff (snus) and packed in standard plastic cans. Each sample was stored at room temperature and in refrigerator (4-8° C.), respectively. pH was measured on day 1 and 3 and subsequently every week until 105 days had passed. FIG. 3 shows the pH-time graph. This shows that the invention is suitable for snus-pouches.

Figure 4:
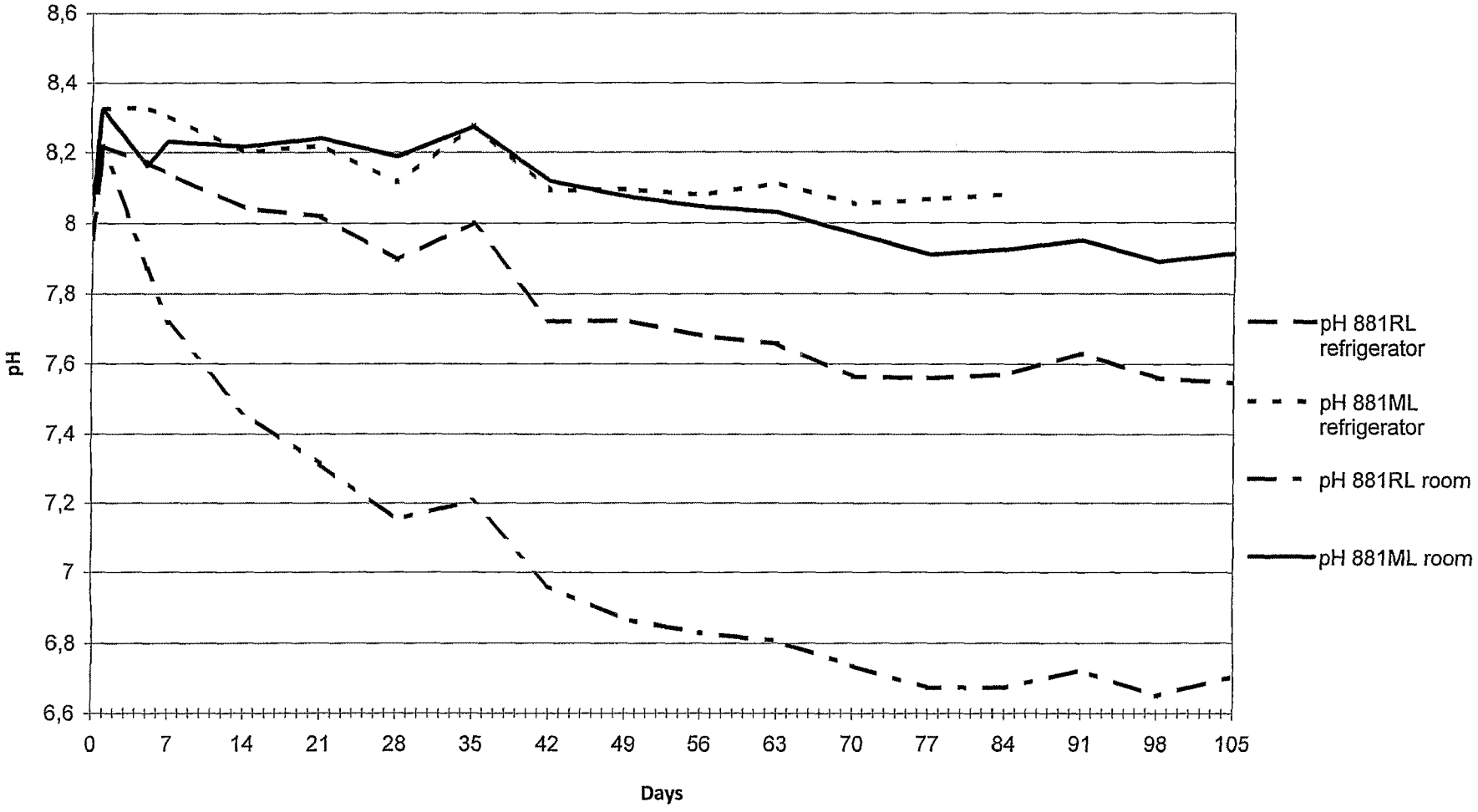

Example 3 (See FIG. 4)

Snus was manufactured in accordance with the GothiaTek® standard with NaCl and reduced soda addition. Sample 881 RL (reference) was not further treated. To sample 881 ML, 1% (of the end product) of magnesium carbonate (CAS-number 546-93-0, UnivarFiskefood AB, Box 4072, Kalendegatan 26, SE-203 11 Malmö, Sweden, product no. MA2725) was added. Both samples were filled into pouches to portion snuff (snus) and packed in standard plastic cans. Each sample was stored at room temperature and in refrigerator (4-8° C.), respectively. pH was measured on day 1 and 3 and subsequently every week until 105 days had passed. FIG. 4 shows the pH-time graph.

Figure 5:
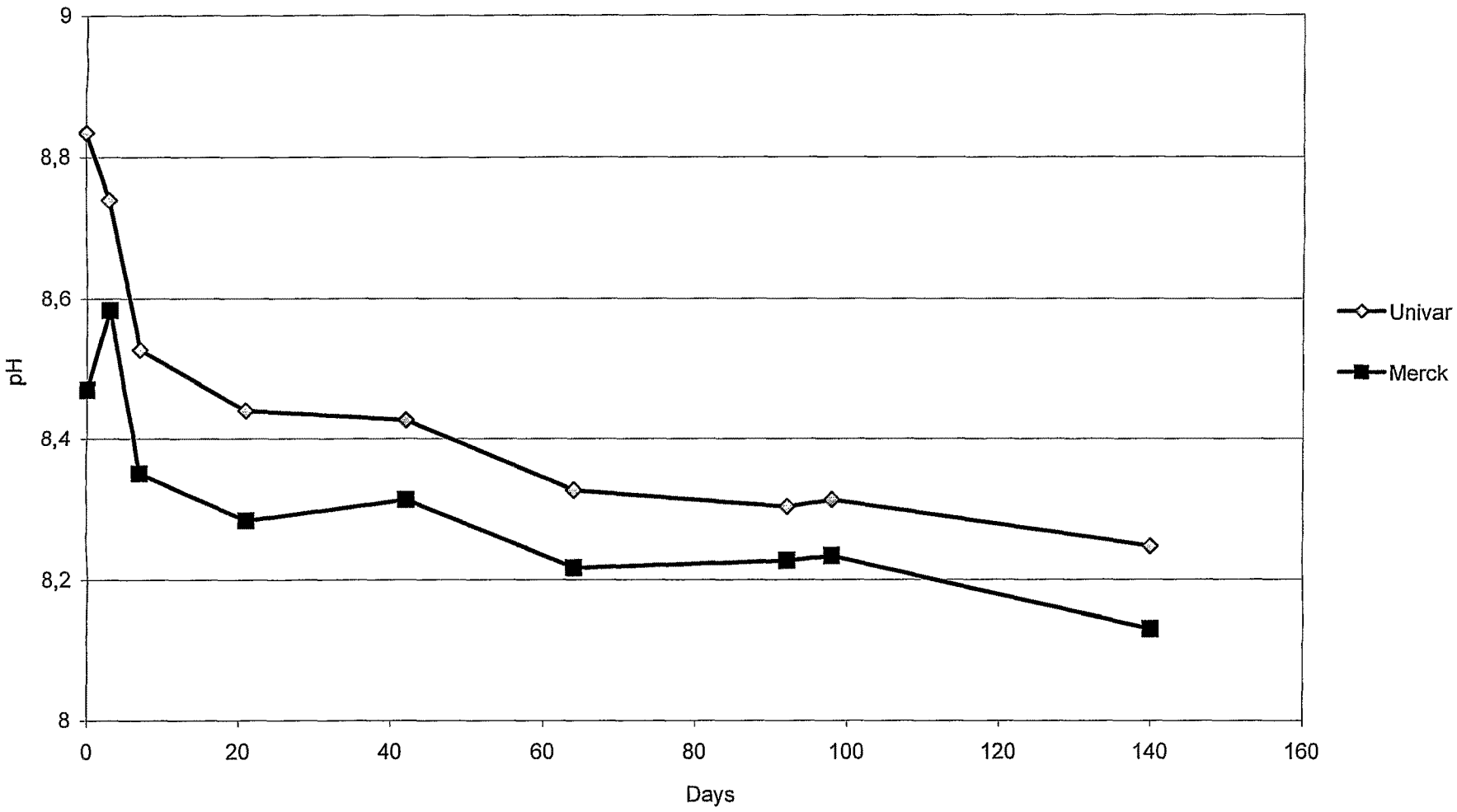

Example 4 (See FIG. 5)

Snus was manufactured in accordance with the GothiaTek® standard with NaCl and soda addition according to recipe 881. To a sample containing the magnesium carbonate denominated Merck, 1% (of the end product) of magnesium hydroxy carbonate (CAS-number 12125-28-9, E. Merck AB, Frösundaviks Allé 1, 169 70 Solna, Sweden, product no. 1.05829.9040) was added and to the sample containing the magnesium carbonate termed Univar, 1% (of the end product) of magnesium carbonate (CAS-number 546-93-0, UnivarFiskefood AB, Box 4072, Kalendegatan 26, SE-203 11 Malmö, Sweden, product no. MA2725) was added. Both samples were packed as loose snuff (snus) in standard cardboard cans. Samples were stored at room temperature. pH was measured every week until 140 days had passed. FIG. 5 shows the pH-time graph. Both types of $MgCO_3$ had about the same stabilizing effect.

Figure 6:
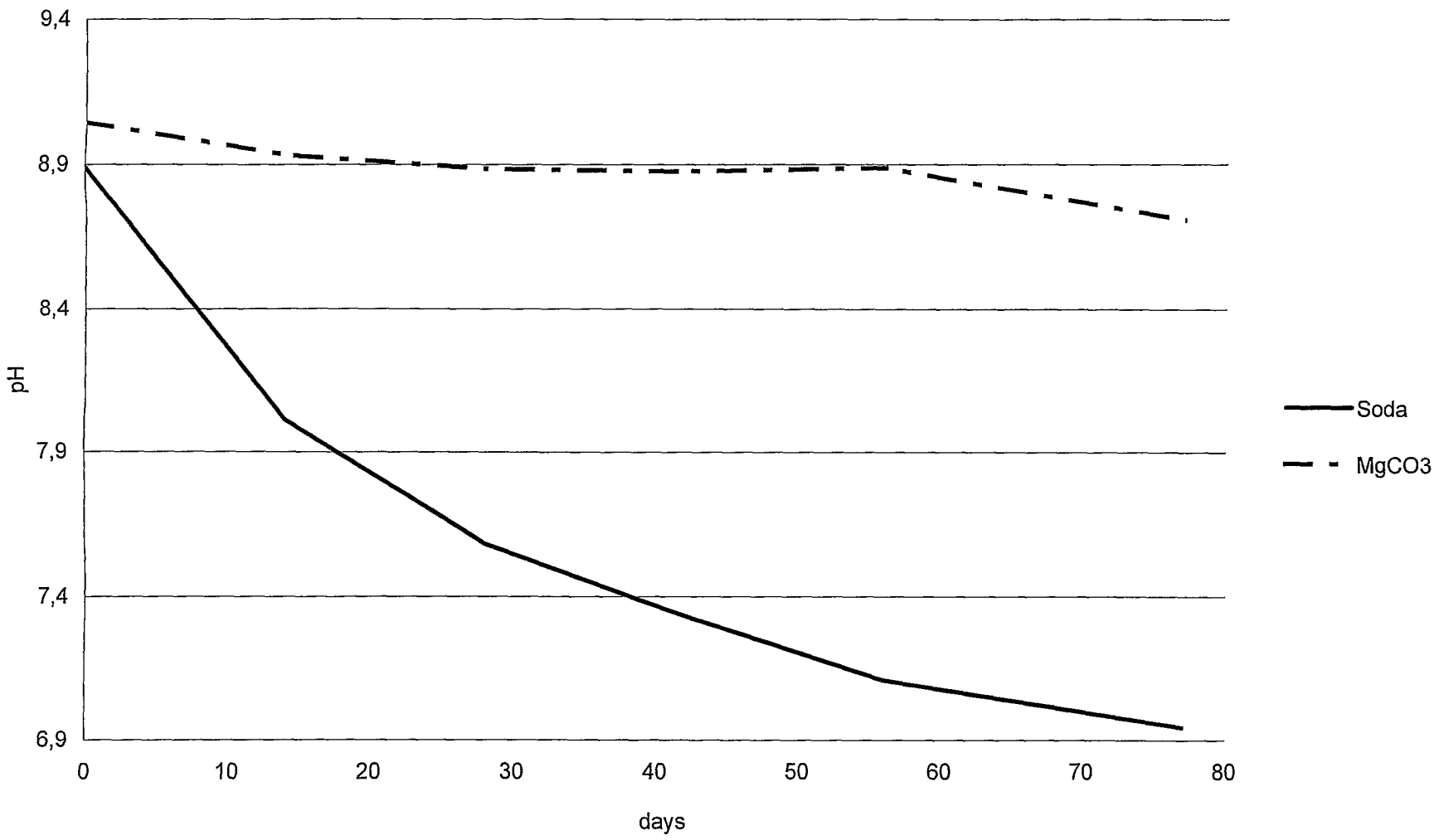
FIG. 6 shows pH comparison between portion snus containing sodium carbonate (soda), and soda and magnesium carbonate ($MgCO_3$), respectively. Samples stored in a climate chamber (30° C., 60% relative humidity).
Figure 7:
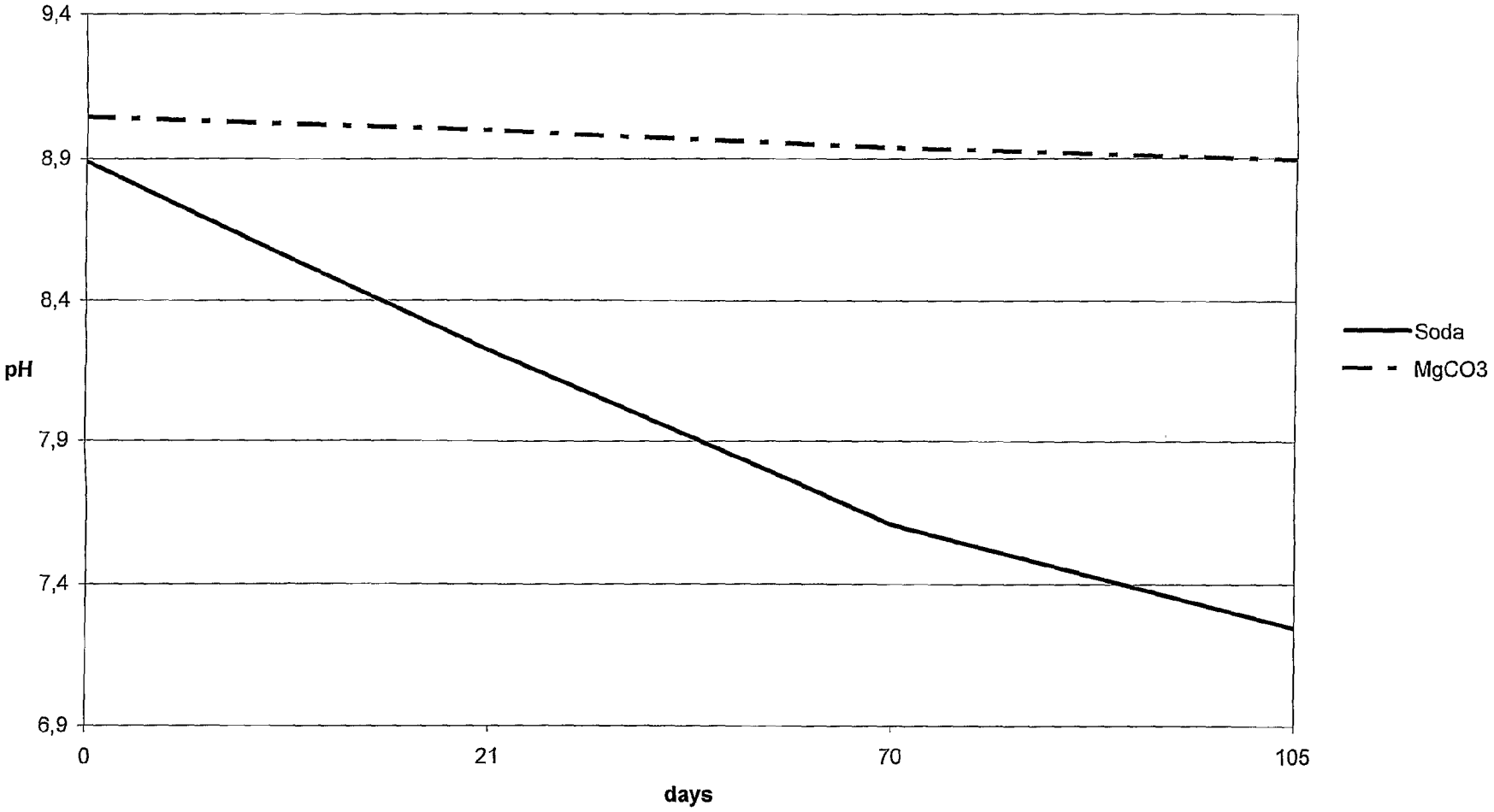
FIG. 7 shows a pH comparison between loose snus containing sodium carbonate (soda), and soda and magnesium carbonate ($MgCO_3$), respectively. Samples stored at room temperature.

Example 5 (See FIGS. 6 and 7)

Snus was manufactured in accordance with the GothiaTek® standard with NaCl and soda addition. To a sample named "$MgCO_3$", 1% (of the end product) of magnesium hydroxy carbonate (CAS-number 39409-82-0, Riedel-de Haën, Sigma-Aldrich, Sweden, product no. 13 117) was added and to the sample named "Soda" no such addition was made. Both samples were packed as loose snus in standard plastic cans. Samples were stored at room temperature (FIG. 7) and in a climate chamber (FIG. 6) at 30° C. and 60% relative humidity, respectively. FIGS. 6 and 7 show the pH at various times. As can be seen when comparing the graphs, the ageing process is more than twice as fast in the climate chamber in respect of the product solely containing soda as addition. Storage in the climate chamber has thus been used as a model for more swiftly assessing the storage capability of the products of the invention, i.e. a measure of the shelf life of the products. A comparison between FIG. 6 and FIG. 7 clearly demonstrates that the model works. Based on this, it is reasonable to expect the pH of samples containing $MgCO_3$ at room temperature to be stabilized for twice as long as the maximum time tested in the climate chamber, i.e. approximately half a year at room temperature.

Example 6 (See FIG. 8)

Snus was manufactured in accordance with the GothiaTek® standard with NaCl and soda addition according to recipe 803. One sample was not further treated and served as reference (named "Soda"). Magnesium hydroxy carbonate (CAS-number 39409-82-0, Riedel-de Haën, Sigma-Aldrich, Sweden, product no. 13 117) was added to three samples, such that the content of magnesium carbonate in the final product was 1%; 1.9% and 3.7%, respectively. All samples were packaged as loose snuff in standard polypropylen cans. The samples were stored at room temperature and the change in pH was monitored during 196 days. FIG. 8 shows the pH-time graph. As is evident from the graph, addition of $MgCO_3$ has the capacity to stabilize the pH in snus for more than half a year at room temperature.

Example 7 (See FIG. 9)

A non-tobacco oral snuff product was manufactured in accordance with the GothiaTek® standard. The fibers used in the manufacture of the oral snuff product were solely maize fibers (Limagrain; SOFABRAN F 184-80, SOFRABRAN F 184-400).

NaCl; 1-5% (by weight of total batch), propylene glycol; 2-10% and water; 40-60% were added before the snuff was heated in the normal heat treatment process common for Swedish heat-treated snuff. After cooling, additional NaCl; 0.5-6%, flavors and soda; 0.3-3% were added. In the next step the batch was divided into two parts. Part 1 (reference), was packed into normal snuff cans without further treatment. Part 2 received an extra addition of 1% $MgCO_3$ (calculated based on dry constituents) before packing. All cans from both parts of the batch were stored at room temperature. Each pH measurement was done on a newly opened snuff can.

As is evident from the graph, addition of $MgCO_3$ has the capacity to stabilize the pH in non-tobacco oral snuff for at least approximately half a year at room temperature.

The invention claimed is:

1. A moist oral tobacco snuff or snus product, comprising:
a pouch containing loose tobacco;
water;
admixed magnesium carbonate; and
a pH-regulator selected from the group consisting of sodium carbonate, sodium bicarbonate, sodium hydroxide, potassium carbonate, potassium bicarbonate, potassium hydroxide, and phosphates, or any combination thereof, wherein the water is present in an amount of from 30 to 60% by weight of the oral tobacco snuff or snus product; and wherein the admixed magnesium carbonate and the pH regulator are present in an amount sufficient to maintain the pH of the moist oral tobacco snuff or snus product between a pH of 8 to 9 after storage at room temperature for at least 90 days.

2. The moist oral tobacco snuff or snus product according to claim 1, wherein the magnesium carbonate is of a formula $MgCO_3.XH_2O$ and/or of a formula $Mg(CO_3)_y(OH)_z.XH_2O$, wherein X, y and z each independently represent a number from 0 to 5.

3. The moist oral tobacco snuff or snus product according to claim 1, wherein the magnesium carbonate is present in an amount of from 0.01 to 30% by weight of the dry bulk material.

4. The moist oral tobacco snuff or snus product according to claim 1, wherein the magnesium carbonate is present in an amount of from 0.1 to 20% by weight of the dry bulk material.

5. The moist oral tobacco snuff or snus product according to claim 1, wherein the magnesium carbonate is present in an amount of from 0.5 to 5% by weight of the dry bulk material.

6. The moist oral tobacco snuff or snus product according to claim 1, wherein the moist oral tobacco snuff or snus product is in a particulate form.

7. The moist oral tobacco snuff or snus product according to claim 1, further packaged in a box, can or canister.

8. The moist oral tobacco snuff or snus product according to claim 1, wherein the magnesium carbonate is anhydrous magnesite ($MgCO_3$).

9. An oral non-tobacco snuff or snus product, comprising:
a pouch containing loose non-tobacco bulk plant fiber material;
a pH-regulator selected from the group consisting of sodium carbonate, sodium bicarbonate, sodium hydroxide, potassium carbonate, potassium bicarbonate, potassium hydroxide, and phosphates, or any combination thereof; and
admixed magnesium carbonate, wherein the oral non-tobacco snuff or snus product does not contain any tobacco, and wherein the admixed magnesium carbonate and the pH regulator are provided in an amount sufficient to maintain the pH of the oral non-tobacco snuff or snus product between a pH of 8 to 9 after storage at room temperature for at least 90 days.

10. The oral non-tobacco snuff or snus product according to claim 9, wherein the magnesium carbonate is of a formula $MgCO_3.XH_2O$ or of a formula $Mg(CO_3)_y(OH)_z.XH_2O$, wherein X, y and z each independently represent a number from 0 to 5.

11. The oral non-tobacco snuff or snus product according to claim 9, wherein the magnesium carbonate is present in an amount of from 0.01 to 30% by weight of the dry bulk material.

12. The oral non-tobacco snuff or snus product according to claim 9, wherein the magnesium carbonate is present in an amount of from 0.1 to 20% by weight of the dry bulk material.

13. The oral non-tobacco snuff or snus product according to claim 9, wherein the magnesium carbonate is present in an amount of from 0.5 to 5% by weight of the dry bulk material.

14. The oral non-tobacco snuff or snus product according to claim 9, wherein the oral non-tobacco snuff or snus product is in a particulate form.

15. The oral non-tobacco snuff or snus product according to claim 9, further packaged in a box, can or canister.

16. The oral non-tobacco snuff or snus product according to claim 9, wherein the magnesium carbonate is anhydrous magnesite ($MgCO_3$).

17. The moist oral tobacco snuff or snus product according to claim 1, further comprising a humectant in an amount of from 2 to 10% by weight of the total product.

18. The moist oral tobacco snuff or snus product according to claim 17, wherein the humectant comprises propylene glycol.

19. The moist oral tobacco snuff or snus product according to claim 1, further comprising sodium chloride in an amount of from 1 to 5% by weight of the total product.

20. The oral non-tobacco snuff or snus product according to claim 9, further comprising a humectant in an amount of from 2 to 10% by weight of the total product.

21. The oral non-tobacco snuff or snus product according to claim 20, wherein the humectant comprises propylene glycol.

22. The oral non-tobacco snuff or snus product according to claim 9, further comprising sodium chloride in an amount of from 1 to 5% by weight of the total product.

23. The oral non-tobacco snuff or snus product according to claim 9, further comprising water in an amount of from 30 to 60% by weight of the total product.

24. The moist oral tobacco snuff or snus product according to claim 1, wherein the moist oral tobacco snuff or snus product has a pH of 8 to 8.5.

25. The moist oral tobacco snuff or snus product according to claim 1, wherein the moist oral tobacco snuff or snus product has a pH of 8.5 to 9.

26. The moist oral tobacco snuff or snus product according to claim 1, wherein the moist oral tobacco snuff or snus product has a pH of 8.5.

27. The oral non-tobacco snuff or snus product according to claim 9, wherein the oral non-tobacco snuff or snus product has a pH of 8 to 8.5.

28. The oral non-tobacco snuff or snus product according to claim 9, wherein the oral non-tobacco snuff or snus product has a pH of 8.5 to 9.

29. The oral non-tobacco snuff or snus product according to claim 9, wherein the oral non-tobacco snuff or snus product has a pH of 8.5.

30. The moist oral tobacco snuff or snus product according to claim 1, wherein the admixed magnesium carbonate and the pH regulator are present in an amount sufficient to maintain the pH of the moist oral tobacco snuff or snus product between 8 to 9 after storage at room temperature for at least half a year.

31. The oral non-tobacco snuff or snus product according to claim 9, wherein the admixed magnesium carbonate and the pH regulator are present in an amount sufficient to maintain the pH of the oral non-tobacco snuff or snus product between 8 to 9 after storage at room temperature for at least half a year.

* * * * *